US006123243A

United States Patent [19]

Pfister et al.

[11] Patent Number: 6,123,243

[45] Date of Patent: Sep. 26, 2000

[54] CARTRIDGE SETTING TOOL

[75] Inventors: Norbert Pfister, Montlingen, Switzerland; Gerhard Ehmig, Rankweil; Tilo Dittrich, Gisingen, both of Austria

[73] Assignee: Hilti Aktiengesellschaft, Schaan, Liechtenstein

[21] Appl. No.: 09/211,893

[22] Filed: Dec. 15, 1998

[30] Foreign Application Priority Data

Dec. 15, 1997 [DE] Germany ..... 197 55 730

[51] Int. Cl.[7] ..... B25C 1/04

[52] U.S. Cl. ..... 227/10; 173/211; 227/10

[58] Field of Search ..... 227/10, 9, 130; 173/210, 211, 162.1

[56] References Cited

U.S. PATENT DOCUMENTS

| | | | |
|---|---|---|---|
| 3,126,630 | 3/1964 | Catlin et al. | 227/10 |
| 3,249,279 | 5/1966 | Behrend et al. | 227/10 |
| 3,331,546 | 7/1967 | Brunelle | 227/10 |
| 3,632,032 | 1/1972 | Termet | 227/10 |
| 4,122,987 | 10/1978 | Jochum et al. | 227/10 |
| 4,134,527 | 1/1979 | Termet | 227/10 |
| 4,533,077 | 8/1985 | Jochum | 227/10 |
| 4,625,442 | 12/1986 | Hill et al. | 227/9 |
| 4,941,391 | 7/1990 | Ehmig et al. | 227/10 |
| 5,538,172 | 7/1996 | Jochum et al. | 227/10 |
| 5,797,534 | 8/1998 | Almeras et al. | 227/10 |
| 5,881,940 | 3/1999 | Almeras et al. | 227/10 |
| 5,901,894 | 5/1999 | Melocco | 227/10 |
| 5,950,900 | 9/1999 | Frommelt et al. | 227/9 |

*Primary Examiner*—Peter Vo
*Assistant Examiner*—Jim Calve
*Attorney, Agent, or Firm*—Brown & Wood, LLP

[57] ABSTRACT

A high pressure gas operated setting tool and including guide cylinder, a fastening element guide (6) arranged, in a setting direction, in front of the guide cylinder and axially displaceable against a spring-biasing force in a direction opposite to the setting direction by a maximum amount (S), a drive piston (8) axially displaceable in the guide cylinder, a return device for displacing the drive piston to its ignition-ready position, and an elastic resetting element (9), surrounding the stem (82) of the drive piston and extending between the stop (73) of the guide cylinder (7) and a front, in the setting direction, end surface of the drive piston head (81), the resetting element (9) having a length corresponding at least to a maximum distance (A) between the stop (73) and the front end surface (83) of the drive piston head (81) reduced by the amount of the axial displacement of the fastening element guide (6).

8 Claims, 3 Drawing Sheets

CARTRIDGE SETTING TOOL

BACKGROUND OF THE INVENTION

1. Field of the Invention

The present invention relates to a high pressure gas operated setting tool including a guide cylinder having a stop, a fastening element guide arranged, in a setting direction, in front of the guide cylinder and displaceable against a spring-biasing force in a direction opposite to the setting direction by a predetermined maximum amount, a drive piston axially displaceable in the guide cylinder and having a head and a stem, and a return device for displacing the drive piston to its ignition ready position.

2. Description of the Prior Art

At present, for driving of nail-shaped fastening elements in a hard structural components containing, e.g., concrete, stone or steel, explosive powder charge operated setting tools are primarily used. Such a setting tool is disclosed, e.g., in European Publication EP-0 798 084. The disclosed setting tool has a housing, a guide cylinder, a drive piston displaceable in the guide cylinder, a fastening element guide arranged in front of the guide cylinder, and a resetting device which cooperates with the fastening element guide and the drive piston. The fastening element guide is displaceable, in a direction opposite to the setting direction, against a spring biasing force. Inside the guide cylinder, there is provided an elastic element which is shaped as a hollow cylinder and surrounds the stem of the drive piston. The elastic element cushions the drive piston at the end of a drive-in process.

The resetting of the drive piston to its ignition-ready initial position is effected in two stages. In the first stage, a portion of a propellant gas, which is generated upon ignition of a cartridge, is conducted through a bypass channel, which is technically very expensive to form, from the region of the cartridge chamber into a front, in the setting direction, region of the guide cylinder. There, the portion of the propellant gas is compressed by the drive piston movable with high speed in the setting direction. After the setting process is completed, these gases expand and displace the drive piston back into its initial position. Final resetting of the drive piston to its ignition-ready initial position is effected in a second stage. First, the fastening element guide is axially displaced relative to the setting tool housing. The resetting device, which cooperates with the fastening element guide, force-lockingly cooperates with the drive piston stem and displaces the drive piston to its initial position.

A serious drawback of the known setting tool consists in that the formation of the bypass channel is very complicated and is, therefore, very expensive, which adversely affects total manufacturing costs of the tool. In addition, using the drive gas for resetting the drive piston to its initial position does not always insure adequate results.

Accordingly, an object of the present invention is to provide a setting tool with a reliable resetting of the drive piston to its initial ignition-ready position and which, at the same time, has a simple construction and can be economically produced.

SUMMARY OF THE INVENTION

These and other objects of the present invention, which will become apparent hereinafter, are achieved by providing an elastic resetting element the length of which corresponds at least to a maximum distance between a stop provided in the guide cylinder and the front, in the setting direction, end surface of the head of the drive piston and reduced by an amount of the maximum displacement of the fastening element guide in the direction opposite to the setting direction. In the setting tool according to the present invention, the first stage of resetting of the drive piston to its ignition-ready initial position is effected with the elastic resetting element. Therefore, the propellant gases produced by the ignition of the propellant powder charge can be used for accelerating the drive piston in their totality.

In order to achieve an appropriate guidance of the resetting element in the guide cylinder the cross-sectional surface of the resetting element, which extends perpendicular to the setting direction, substantially corresponds to a cross-sectional surface between the guide cylinder and the stem of the piston which also extends perpendicular to the setting direction.

To insure an adequate compression of the resetting element, which can reach up to 80% of its initial length, the resetting element is formed as a shaped member having a substantially closed cellular structure. The use of a such shaped member permits to produce a very compact setting tool having reduced length. Upon application of pressure, first, separate cells of the cellular structure are compressed, and then the entire member is compressed. Maximum compression depends on a balk density of the shaped member. Thus, the balk density of the shaped member can amount to 350 kg/m$^3$ to 650 kg/m$^3$, and the volume of cells may reach from 51% to 80% of the entire volume of the resetting element.

Based on desired rigidity, deformability and recycling capability, preferably, the resetting element is formed of an elastomeric polyurethane.

The cellular structure of the resetting element according to the present invention is obtained, e.g., by a foaming process. Preferably, the diameter of the separate cells of the cellular structure is maximum 0.5 mm.

In order to provide for a controlled deformation during the axial compression of the resetting element, advantageously, the shaped member has at least one circumferential groove. Providing of a circumferential groove reduces the cross-section and, thus, reduces the rigidity of the shaped member in the groove region. As a result, the shaped member first becomes compressed in the region of the groove. The shaped member can have a plurality of groove distribution over the entire length of the shaped member or at least concentrated in one end region of the shaped member. The distance between the grooves, their depth, and their width, in the longitudinal direction of the shaped member, can be constant or irregular.

Based on the manufacturing consideration, the groove is provided in a plane extending perpendicular to the longitudinal axis of the shaped member and has a V-shape.

The end surfaces of the shaped member are subject to high mechanical loads. In particular, the end surface of the shaped member located adjacent to the drive piston is subjected to high temperatures. To insure an adequate protection of the shaped member, a support member is provided at least at one side of the shaped member.

The protection of the shaped member with a support member is only then possible when the support member is arranged coaxially with the shaped member. In order to achieve a necessary coaxial alignment of the shaped member with the support member which, if necessary, can have the same diameter as the shaped member, the shaped member and the support member can form-lockingly be engaged with each other.

it is also possible, e.g., to coaxially align the shaped member with respect to the piston displacement. To this end, a support member is provided on each side of the shaped member, with the diameter of the support members substantially corresponding to the inner diameter of the guide cylinder. In this case also, a form-locking connection of the support members with the shaped member may be necessary. To reduce wear and to insure good damping characteristics, the support member or members is (are) formed of rubber.

Based on manufacturing considerations, the resetting member advantageously is formed of several parts.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
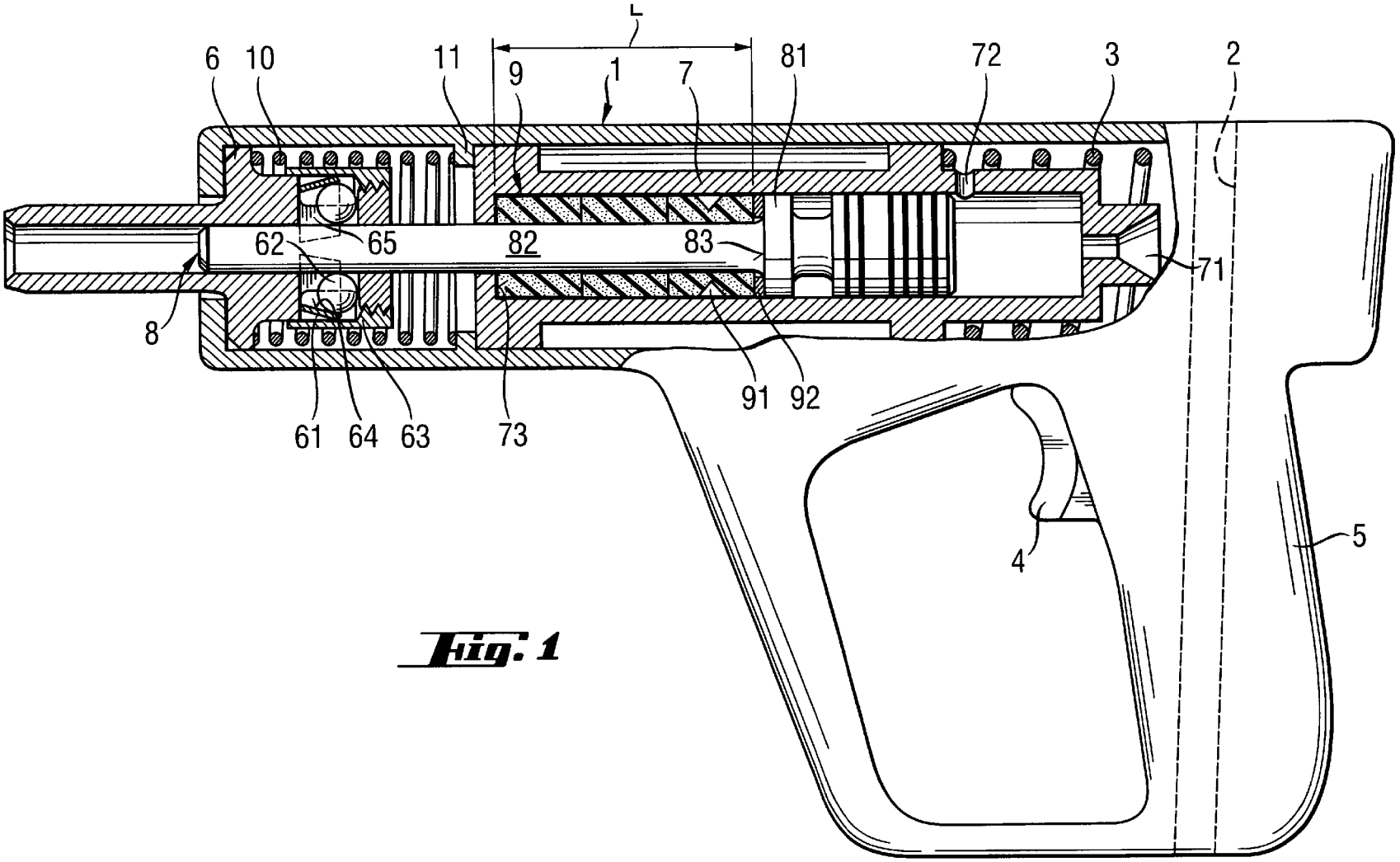
FIG. 1 shows a simplified, partially cross-sectional, side view of a setting tool according to the present invention, with the setting tool in its non-operational position and with the drive piston occupying an intermediate position in the guide cylinder.
Figure 2:
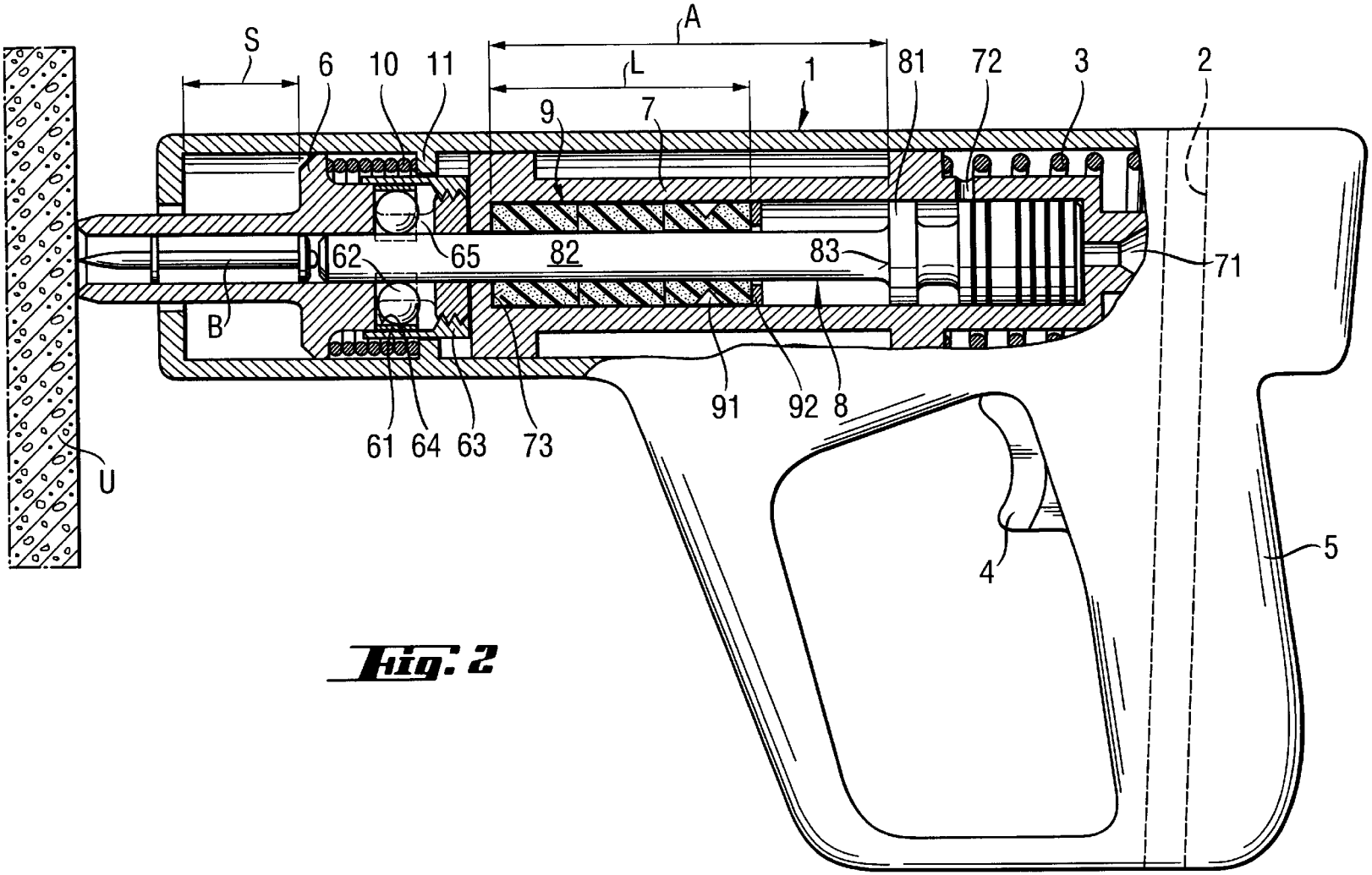
FIG. 2 shows a view similar to that of FIG. 1, with the setting tool in its operational, setting position and with the drive piston occupying its ignition-ready initial position.
Figure 3:
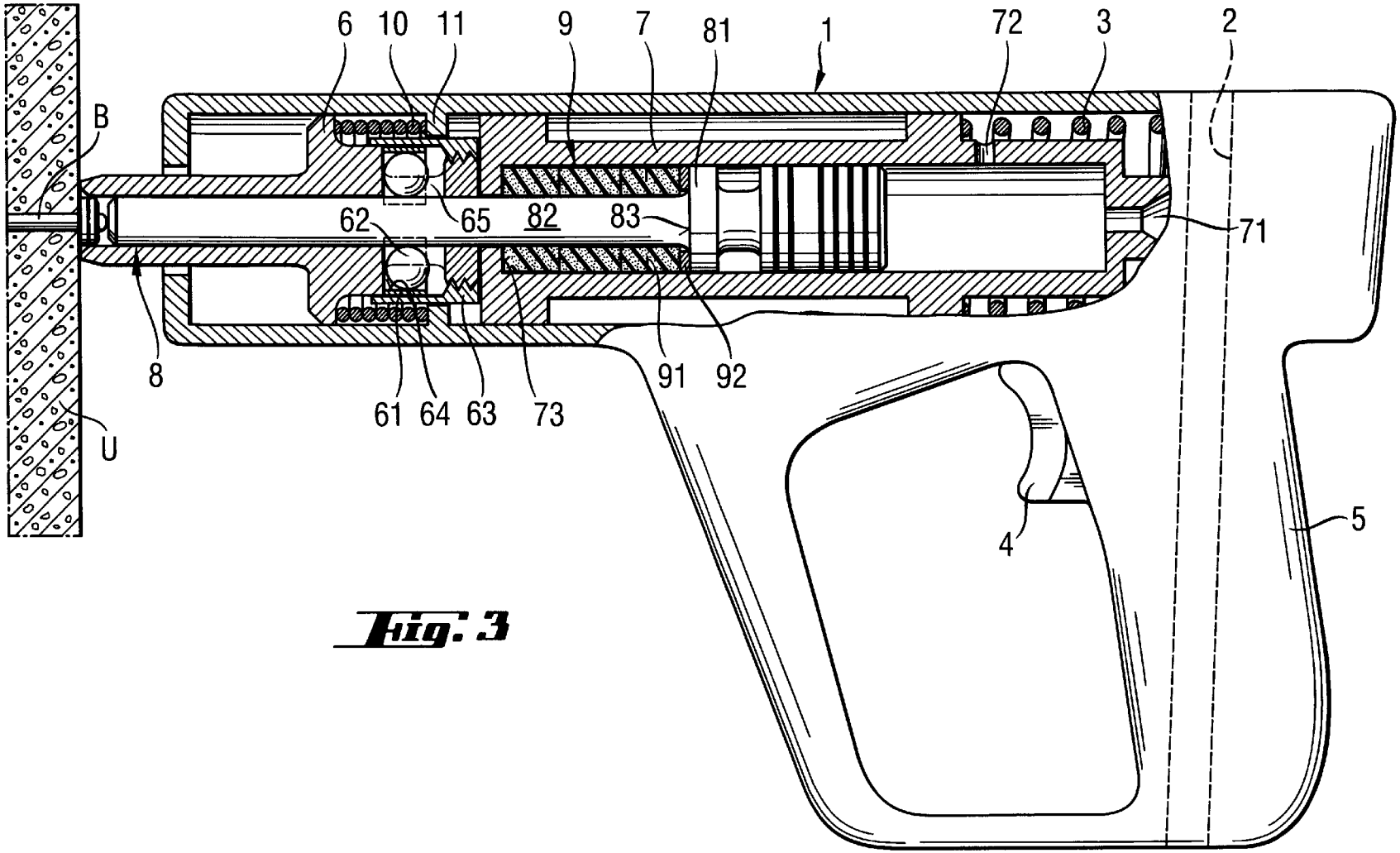
FIG. 3 shows a view of similar to those of FIGS. 1 and 2, with the setting tool in its setting position and with the drive piston occupying its end, drive-in position.

An explosive powder charge operated setting tool according to the present invention, which is shown in FIGS. 1–3, includes a housing 1, a handle 5 formed integrally with the housing as a one-piece part, and a guide channel 2 for receiving a strip-shaped cartridge magazine (not shown in the drawings). A trigger 4 is provided in the transitional region between the housing 1 and the handle 5. The trigger 4 serves for actuation of an ignition mechanism (not shown). In the front, in a setting direction, region of the housing 1, there is arrange a fastening element guide 6 a portion of which projects beyond a front, in a setting direction, end surface of the housing 1. The fastening element guide is axially displaceable relative to the housing 1. At the rear side of the fastening element guide 6, there is arranged a guide cylinder 7 likewise axially displaceable relative to the housing 1.

The guide cylinder 7 has in its end region, remote from the fastening element guide, a cartridge chamber 71 in which a cartridge, not shown is received when the guide cylinder 7 is displaced, together with the fastening element guide 6, in a direction opposite to the setting direction. The guide cylinder 7 is displaceable against a spring-biasing force of a spring 3. The displacement position of both the fastening element guide 6 and the guide cylinder 7 is shown in FIG. 2.

Inside the guide cylinder 7, there is provided a drive piston 8 having a stem 82 and a head 81 provided at an opposite to the setting direction end of the stem 82. The head 81 extends radially beyond the stem 82. The cross-section of the head 81 substantially corresponds to the inner diameter of the guide cylinder 7. The stem 82 has a constant diameter. The drive piston 8 is displaceable in the drive cylinder 7. An exhaust opening 72 provided in the circumferential wall of the guide cylinder 7 serves for flushing the inner space of the cylinder 7. The housing 1 has an annular stop 11 projecting radially inward and against one side of which a spring 10, which biases the fastening element guide 6 in a setting direction, is supported. The opposite side of the stop 11 is engaged by a guide cylinder 7 when the setting tool is its non-operational position shown in FIG. 1.

A resetting element 9 is located in the guide cylinder 7 between a stop 73 formed in the guide cylinder 7 and a front, in the setting direction, end surface 83 of the head 81 of the drive piston 8. The elastic resetting element 9 services for returning the drive piston 8, after a completion of a setting process from its drive-in, end position shown in FIG. 3 to the position shown in FIG. 1. As shown in FIG. 1, the resetting element 9, which has an initial length L, is formed of several ring-shaped sections. One of the section is provided with a circumferential groove 91 which facilitates the deformation of the resetting element 9. A rubber support disc 92 is arranged between the end surface 83 and the resetting element 9.

During the initial stage of a setting process, when the setting tool is pressed against a structural component, the fastening element guide 6 is displaced in a direction opposite to the setting direction and compresses the spring 10 which is formed as a pressure spring. At its end opposite to the setting direction, the fastening element guide 6 has a return device formed of a plurality of balls 62 and a radially expandable spring ring 61 the inner surface 64 of which engages the balls 62. The radially expandable spring ring 61 has a conical shape and is widened in a direction opposite to the setting direction. The return device provides a friction-locking connection between the fastening element guide 6 and the stem 82 of the drive piston 8 when the fastening element guide 6 is displaced in the direction opposite to the setting direction upon being pressed against a structural component. The balls 62 are received in radial recesses 65 of the fastening element guide 6. The axial extent of each recess 65 is greater than a diameter of the ball 62. The recesses 65 are closed with a sleeve-shaped cover member 63 threadably secured in the fastening element guide 6.

Below, a setting process with the use of a setting tool according to the present invention will be described.

At the beginning of the setting process when the setting tool is not yet pressed against a structural component, the setting tool occupies a position shown in FIG. 1. In the position shown in FIG. 1, the front end surface 83 of the drive piston head 82 abuts an end of the resetting element 9 facing in the direction opposite to the setting direction. In that position, the drive piston head 81 does not cover the exhaust opening 72, and it serves for ventilating or cooling the inner space of the guide cylinder 7.

As shown in FIG. 2, before a start of a drive-in process, a fastening element B is pushed into the end region of the fastening element guide 6 facing in the setting direction. Then, the setting tool is pressed against a structural component U. At that, the fastening element guide 6 becomes displaced by an amount S. The guide cylinder 7 is also displaced. The pressure spring 10 becomes also compressed. The drive piston 8 is also displaced to its ignition-ready initial position. The displacement of the guide cylinder 7, together with the drive piston 8, is effected by the return device. In the displaced position of the drive piston 8, the piston head 81 adjoins the cartridge chamber 71. The front end surface 83 of the drive piston head 81 is spaced from a stop 73 provided in the guide cylinder 7. The displacement of the drive piston 8 to its ignition-ready position is effected by the return device which force-lockingly, in particular, friction-lockingly engages the stem 82 of the drive piston 8.

In the position shown in FIG. 3, a cartridge is ignited by the ignition mechanism not shown. After ignition, the drive piston rapidly moves in the setting direction, and the fastening element B, which is located in the fastening element guide 6, is driven into the structural component U. When the drive piston 8 is displaced in the setting direction, it compresses the elastic resetting element 9. When, upon the fastening element B having been driven into the structural component U, the setting tool is lifted off the structural component U, the pressure spring 10 returns the fastening element guide 6 in its initial position, and the resetting element 9 returns the drive piston 9 into its starting intermediate position shown in FIG. 1.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A high pressure gas-operated setting tool, comprising a guide cylinder (7) having a stop (73); a drive piston (8) axially displaceable in the guide cylinder (7) and having a head (81) and a stem (82), the drive piston (8) having a starting, intermediate position, an ignition-ready position, and an operational position; a fastening element guide (6) arranged, in a setting direction, in front of the guide cylinder (7) and axially displaceable against a spring-biasing force into an operational position thereof by an axial distance (S); means for displacing the drive piston (8) to the ignition-ready position thereof in response to the fastening element guide (6) being displaced to the operational position thereof; and an elastic resetting element (9) for displacing the drive piston (8) from the operational position thereof to the starting, intermediate position thereof, the resetting element (9) surrounding the stem (82) and extending between the stop (73) and a front, in the setting direction, end surface (83) of the drive piston head (81), the resetting element (9) having a cross-sectional area that corresponds to a cross-sectional area between the guide cylinder (7) and the stem (82) of the piston (8), and an initial length (L) substantially equal to a distance (A) between the stop (73) and the front end surface (83) of the drive piston head (81) in the ignition-ready position of the drive piston (8) reduced by the axial distance (S) of the axial displacement of the fastening element guide (6).

2. A setting tool according to claim 1, wherein a cross-sectional surface of the resetting element (9), which extends perpendicular to the setting direction, substantially corresponds to a cross-sectional surface between the guide cylinder (7) and the stem (82) of the piston (8) which also extends perpendicular to the setting direction.

3. A setting tool according to claim 1, wherein the resetting element (9) is formed as a shaped member having a substantially closed cellular structure.

4. A setting tool according to claim 3, wherein separate cells of the cellular structure of the shaped member have a diameter that amounts at most to 0.5 mm.

5. A setting tool according to claim 3, wherein the shaped member has at least one circumferential shaped groove (91).

6. A setting tool as set forth in claim 5, wherein the shaped groove is provided in a plane extending perpendicular to a longitudinal axis of the shaped member, and has a V-shape.

7. A setting tool as set forth in claim 3, further comprising a support disc (92) provided at at least one of the opposite end surfaces of the shaped member.

8. A setting tool according to claim 1, wherein the resetting element (9) is formed of a plurality of separate parts.

* * * * *

UNITED STATES PATENT AND TRADEMARK OFFICE

CERTIFICATE OF CORRECTION

PATENT NO. : 6,123,243
DATED : September 26, 2000
INVENTOR(S) : Norbert Pister, et al It is certified that error appears in the above-identified patent and that said Letters Patent is hereby corrected as shown below:

Item [75] Inventors:
Norbert Pfister, Montlingen, Switzerland; Gerhard Ehmig, Rankwell, Tilo Dittrich, Feldkirch, both of Austria.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*